US005982904A

United States Patent [19]

Eghtesadi et al.

[11] Patent Number: 5,982,904

[45] Date of Patent: Nov. 9, 1999

[54] WIRELESS HEADSET

[75] Inventors: Khosrow Eghtesadi, Brookfield; Mark F. Cullen, Bethany, both of Conn.

[73] Assignee: Voice Communication Interface Corp., Wilton, Conn.

[21] Appl. No.: 09/009,866

[22] Filed: Jan. 22, 1998

[51] Int. Cl.[6] ..... H04R 1/10

[52] U.S. Cl. ..... 381/74; 381/311; 455/90

[58] Field of Search ..... 381/300, 309, 381/311, 74; 455/66, 90, 351, 569, 575

[56] References Cited

U.S. PATENT DOCUMENTS

| | | | |
|---|---|---|---|
| 4,558,178 | 12/1985 | Yasuda et al. . | |
| 4,661,659 | 4/1987 | Nishimura . | |
| 4,815,143 | 3/1989 | Derhaag et al. . | |
| 5,218,641 | 6/1993 | Abe et al. . | |
| 5,428,388 | 6/1995 | Von Bauer | 455/66 |
| 5,621,913 | 4/1997 | Tuttle | 455/66 |
| 5,671,158 | 9/1997 | Fournier et al. . | |

*Primary Examiner*—Minsun Oh Harvey
*Attorney, Agent, or Firm*—St.Onge Steward Johnston & Reens LLC

[57] ABSTRACT

A wireless headset is provided, comprising: a microphone for receiving a first audio signal and for generating a corresponding microphone electrical signal; a portable receiver/transmitter electrically connected to the microphone for transmitting a first carrier frequency modulated according to the microphone's electrical signal; a remote receiver/transmitter for receiving and demodulating the modulated first carrier frequency to generate a first electrical signal corresponding to the microphone electrical signal, the remote receiver/transmitter also for transmitting a second carrier frequency modulated according to a second electrical signal; the portable receiver/transmitter also for receiving and demodulating the second modulated carrier frequency to generate a speaker electrical signal; and a speaker electrically connected to the portable receiver/transmitter for transforming the speaker's electrical signal into a second audio signal, one of the first and second carrier frequencies being above 900 Megahertz, the other of the first and second carrier frequencies being below 900 Megahertz.

8 Claims, 3 Drawing Sheets

WIRELESS HEADSET

FIELD OF THE INVENTION

The present invention relates to wireless communication systems that transmit and receive wireless audio.

BACKGROUND OF INVENTION

Both wireless microphones with transmitters and wireless receivers with speakers are well known. For example, U.S. Pat. No. 4,815,143 to Derhaag, et al. discloses a wireless microphone and U.S. Pat. No. 5,218,641 to Abe, et al. discloses a wireless receiver. The disadvantage with both these systems is that they both apparently involve only one way communication. With either system alone, a user cannot transmit and receive wireless communications.

U.S. Pat. No. 4,661,659 to Nishimura discloses a wireless phone system communicatively combined with a computer. The system uses a wireless phone receiver connected to a master phone unit which both have a central processing unit. Disadvantageously, crosstalk may occur between the transmitted and received audio because the wireless phone system in Nishimura does not transmit and receive the wireless audio on different radio frequencies. This is not desirable if the user wants to talk to a computer and listen to computer generated audio. The Nishimura apparatus further does not use a sound card with the computer to facilitate the computer generation of speech from text or computer speech recognition.

U.S. Pat. No. 5,671,158 to Fournier et al. discloses an apparatus for effecting wireless communications and video information between a computer and a technician for testing motor vehicle emission control systems. A motor vehicle technician can transmit wireless audio to a computer which can transmit wireless video and audio to the technician. The computer provides speech recognition and generates audio speech from text using a commercial sound card. The disadvantage with the Fournier apparatus is that both audio and video are simultaneously transmitted to the user. The user may desire only to transmit and receive wireless audio. If only audio is desired, a video visor affixed to the user interface of the Fournier device may undesirably obstruct the field of view of the user. Furthermore, the video interface makes the apparatus more expensive. Finally, the Fournier apparatus does not transmit and receive wireless audio communications on different radio frequencies.

What is desired, therefore, is a wireless headset that transmits and receives audio on different frequencies, wherein a user transmits voice signals through a sound card to a computer using voice recognition and the user receives audio from the computer which generates speech from text.

SUMMARY OF THE INVENTION

Accordingly, it is an object of the present invention to provide a wireless headset that transmits and receives audio on different carrier frequencies, wherein a user transmits voice signals through a sound card to a computer using voice recognition and the user receives audio from the computer which generates speech from text.

It is another object to provide a wireless headset of the above character wherein the user's transmitter and receiver are contained in a compact beltpack.

It is a further object to provide a wireless headset of the above character using a combination of off-the-shelf components.

It is yet another object to provide a wireless headset of the above character wherein one of the carrier frequencies is above 900 Megahertz and the other carrier frequency is below 900 Megahertz.

It is still another object to provide a wireless headset of the above character having a power circuit capable of operating a receiver and a transmitter circuit having different input voltage requirements.

These objects of the invention are achieved by a wireless headset, comprising: a microphone for receiving a first audio signal and for generating a corresponding microphone electrical signal; a portable receiver/transmitter electrically connected to the microphone for transmitting a first carrier frequency modulated according to the microphone's electrical signal; a remote receiver/transmitter for receiving and demodulating the modulated first carrier frequency to generate a first electrical signal corresponding to the microphone electrical signal, the remote receiver/transmitter also for transmitting a second carrier frequency modulated according to a second electrical signal; the portable receiver/transmitter also for receiving and demodulating the second modulated carrier frequency to generate a speaker electrical signal; and a speaker electrically connected to the portable receiver/transmitter for transforming the speaker's electrical signal into a second audio signal, one of the first and second carrier frequencies being above 900 Megahertz, the other of the first and second carrier frequencies being below 900 Megahertz.

DETAILED DESCRIPTION OF THE INVENTION

Figure 1:
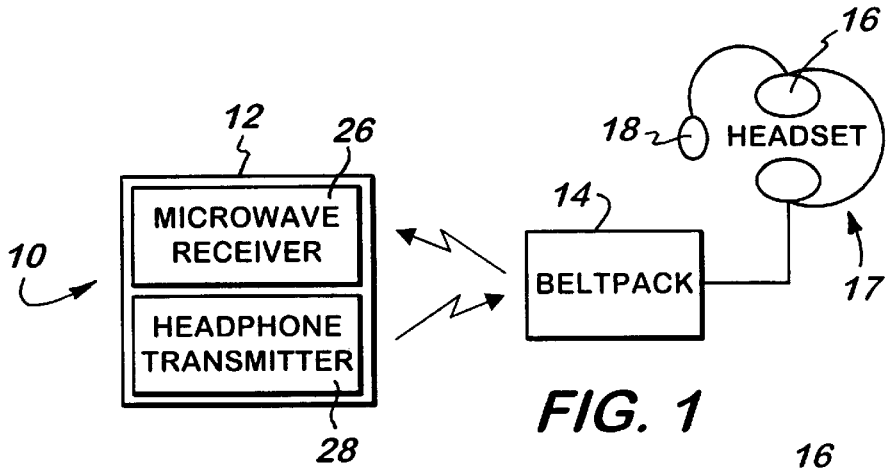
FIG. 1 is a block diagram of a wireless headset in accordance with the invention.

A wireless communication system in accordance with the invention is shown in FIG. 1. The wireless headset 10 comprises a remote receiver/transmitter 12, a portable battery powered receiver/transmitter 14, a speaker 16 and a microphone 18.

The remote receiver/transmitter 12 transmits and receives on different carrier frequencies so that cross talk will not occur between the two channels when the user is speaking and the remote receiver/transmitter 12 is transmitting a signal. In other words, the user will not receive his own voice in his headset 17 and the speech processor 22 will not receive its own transmitted speech from text. The remote receiver/transmitter 12 may consist of two separate modules—a microphone receiver module 26 and a headphone transmitter module 28. In the preferred embodiment of the invention, the microphone receiver module 26 is the Shure T-series wireless microphone receiver box and the headphone transmitter 28 module is the Recoton W200 series wireless headphone transmitter. The Shure T-series wireless microphone transmits a fixed second carrier frequency between 169 and 216 Megahertz. The Recoton W200 series wireless headphone transmits a tunable first carrier frequency between 912 and 914 Megahertz. The first and second carrier frequencies are modulated in proportion to a microphone electrical signal and an electrical output signal of the speech processor, respectively.

Figure 3:
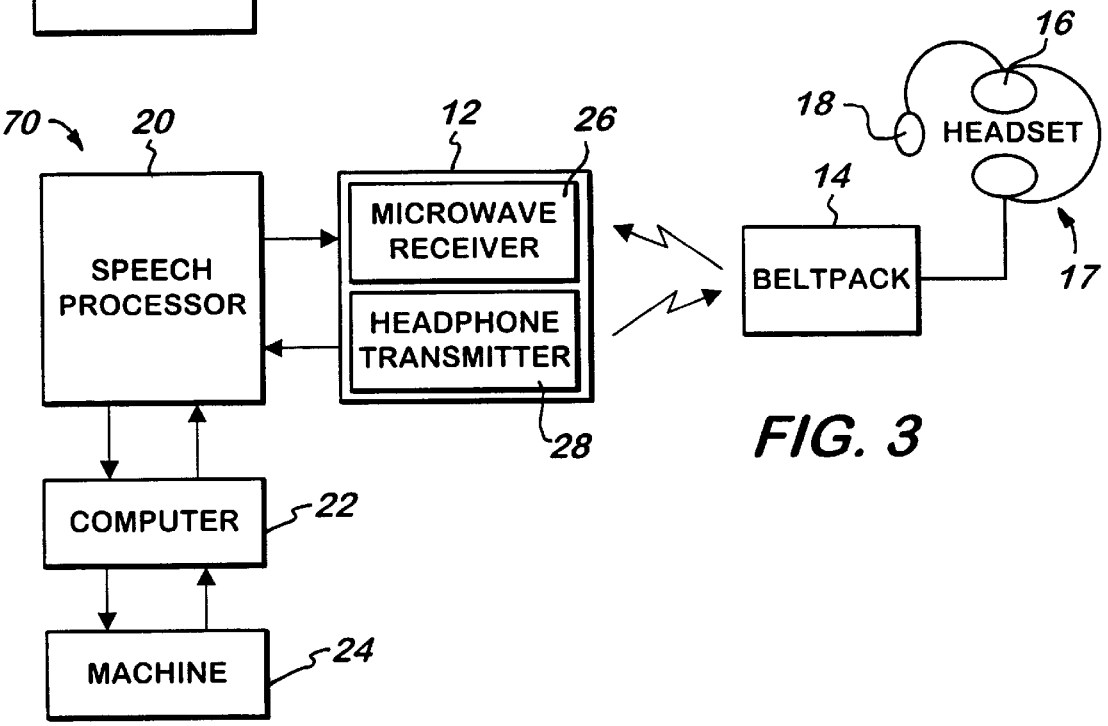
FIG. 3 is a block diagram of the wireless headset of FIG. 1 with a speech processor, a computer and an external machine.
Figure 4:
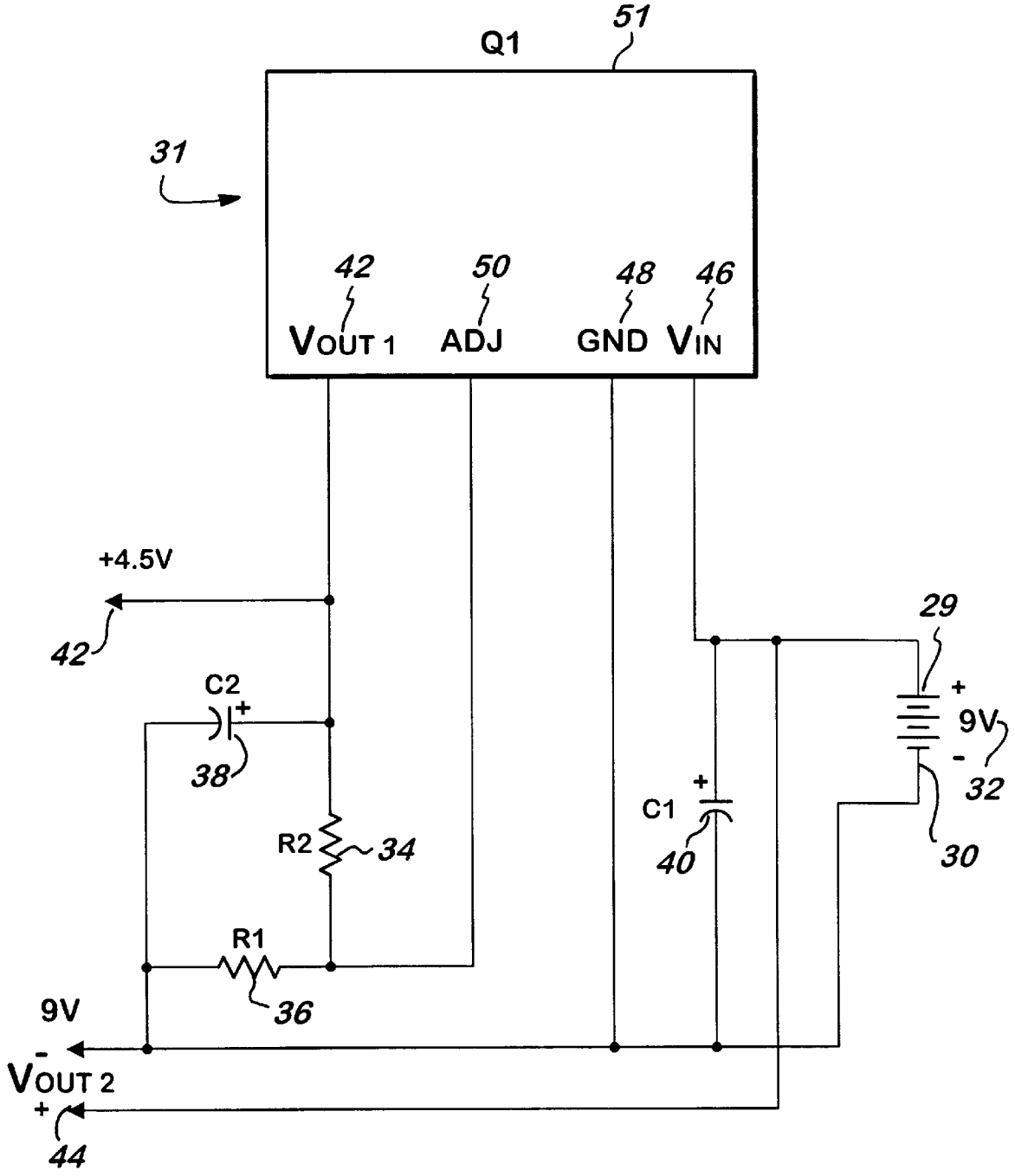
FIG. 4 is a circuit diagram of the power distribution board used in the beltpack of FIG. 1.
Figure 5:
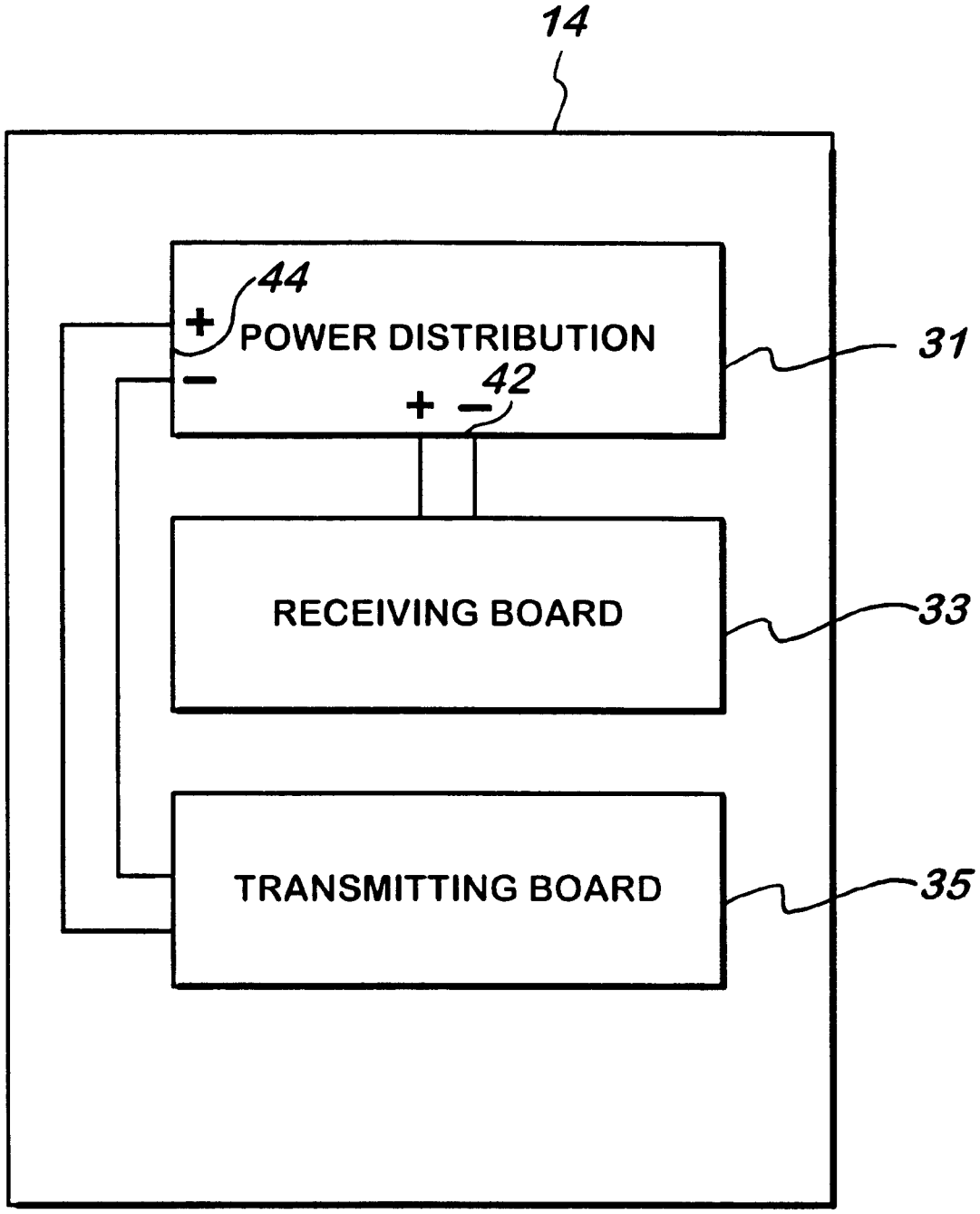
FIG. 5 is a block diagram of the beltpack of FIG. 1.

Referring to FIGS. 4 and 5, a portable receiver/transmitter 14 is powered by a battery 32 and comprises a power distribution board 31, a receiving board 33 and a transmitting board 35. The battery 32 provides an input voltage to the power distribution board 31 which provides first 42 and second 44 output voltages at different voltage levels. The first output voltage 42 powers the receiving board 33 and the second output voltage 44 powers the transmitting board 35. In the preferred embodiment of the invention, a standard 9-volt battery 32 powers the power distribution board 31 which outputs the first voltage level 42 of 4.5 volts to the receiving board 33 and the second voltage level 44 of 9 volts to the transmitting board 35. The receiving board 33 is preferably extracted from a Recoton W200 wireless headphone receiver model. The transmitting board 35 is preferably extracted from a Shure wireless microphone (T-series) transmitter model. The above boards can be packaged in a box, such as the PACTEC HM series box, and made to operate as a beltpack unit. The portable receiver/transmitter 14 is referred to as a beltpack in FIGS. 1–3.

A microphone 18 creates an electrical signal and is attached to the transmitting board 35 of the portable receiver/transmitter 14. The microphone 18 can be a conventional microphone or any device that transforms a spoken audio signal into an electrical signal. A speaker 16 is connected to the receiving board 33 of the portable receiver/transmitter 14 and receives an electrical signal. The speaker can be any type of an audio transducer 16 such as a headphone, headset, an earspeaker or any device that transforms an electrical signal into an audio signal. In the preferred embodiment of the invention, a headset 17 is used which includes the microphone 18 and an earspeaker so that the user can communicate with the speech processing equipment while maintaining both hands free.

The circuit design for the power distribution board 31 is shown in FIG. 4. The power distribution board 31 is preferably constructed around a micropower regulator IC, 51, manufactured by Linear Technology. To use the Linear Technology micropower regulator IC, the Vin pin 46 of the regulator 51 is electrically connected to the plus terminal 29 of a 9-volt battery 32. The ground terminal 30 of the battery 32 is connected to the ground pin 48 of the regulator 51. A first capacitor 40 with a preferable value of 3.3 microfarads is electrically connected in parallel with the battery 32. The positive 29 and ground 30 terminals of the battery 32 are electrically connected to the transmitting board 35 to provide it with 9 volts. Electrically connected between the Vout pin 42 of the regulator 51 and the ground terminal 30 of the battery 32 are a second capacitor 38 and first 36 and second 34 resistors electrically connected in parallel with the second capacitor 38. Preferably, the second capacitor 38 has a valve of 3.3 microfarads and the first 36 and second 34 resistors have valves of 91 k ohms and 18 k ohms, respectively. The first 40 and second 38 capacitors function to buffer the second output voltage 44 and the first output voltage 42, respectively.

The ADJ pin 50 of the regulator 51 is electrically connected to the junction between the first 36 and the second 34 resistors. The first and second resistors act to adjust the first output voltage 42. The first output voltage 42 of the regulator 51 is electrically connected to the receiving board 33 to provide it with 4.5 volts.

It should be understood that other combinations of ICs and/or devices could be utilized to provide the same function as the power regulator. The power distribution board 31 can be constructed from any power regulating device that can be battery operated and that has an output voltage adjustable to 4.5 volts. Alternatively, a voltage dividing circuit may be sufficient to provide adequate voltage and power to the receiving board 33 and transmitting board 35.

Figure 2:
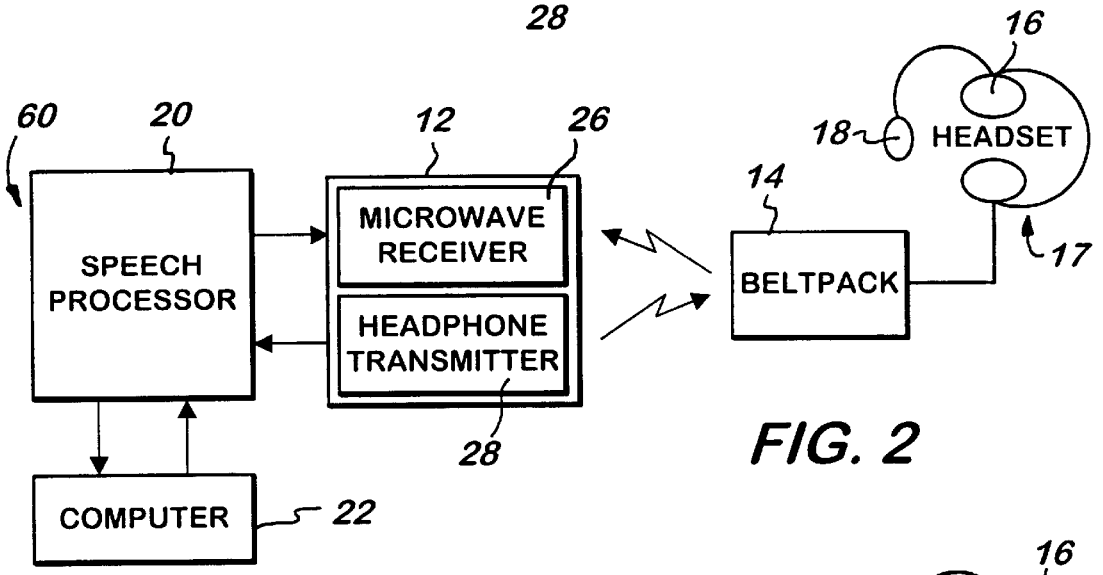
FIG. 2 is a block diagram of the wireless headset of FIG. 1 with a speech processor and a computer.

The second embodiment of the invention is shown in FIG. 2. The second embodiment of the communications system 60 includes a speech processor 20 and a computer 22. The speech processor 20 can be a conventional computer sound card such as those manufactured by Creative Labs. The computer is preferably a conventional computer, labtop or the equivalent, but can also be a microprocessor or processor. The computer sound card will take an external analog electrical signal and convert it into digital for the computer. The same sound card can either convert a digital signal from the computer to analog or can interpret a digital command from the computer to generate a certain audio signal.

The speech processing capabilities, which include speech from text and speech recognition, can be generated through the use of the computer 22, computer software and a sound card. With the use of the speech processor 22, a user will be able to communicate commands or factual statements to a computer 22 or microprocessor. The computer 22 or microprocessor can then determine what action to take, such as communicating an audio command or factual statement back to the user. Conversely, the computing device may first give commands to the user with the user then responding to the computing device.

In the third embodiment of the communications system 70, shown in FIG. 3, the computer 22 can be connected to an external machine 24, such as a robotic device or test equipment, to accept commands from the computer 22. In this scenario, the speech processor 20 could communicate to the user that the user's command was successfully completed or that it wasn't.

It should be understood that the foregoing is illustrative and not limiting and that obvious modifications may be made by those skilled in the art without departing from the spirit of the invention. Accordingly, reference should be made primarily to the accompanying claims, rather than the foregoing specification, to determine the scope of the invention.

What is claimed is:

1. A wireless headset, comprising:

a microphone for receiving a first audio signal and for generating a corresponding microphone electrical signal;

a portable receiver/transmitter electrically connected to said microphone for transmitting a first carrier frequency being above 900 Megahertz and modulated according to the microphone electrical signal;

a remote receiver/transmitter for receiving and demodulating the modulated first carrier frequency to generate a first electrical signal corresponding to the microphone electrical signal, said remote receiver/transmitter also for transmitting a second carrier frequency being below 900 Megahertz and modulated according to a second electrical signal;

said portable receiver/transmitter also for receiving and demodulating the second modulated carrier frequency to generate a speaker electrical signal corresponding to the second electrical signal;

a speaker electrically connected to said portable receiver/transmitter for transforming the speaker electrical signal into a second audio signal;

a power distribution board being electrically connectable to a battery and adapted to accept a voltage from the battery, said power distribution board for generating a first output voltage and a second output voltage, said first output voltage having a voltage level different than said second output voltage;

a receiver board being electrically connected to said first output voltage of said power distribution board, said receiver board for receiving and demodulating the second carrier frequency; and a transmitter board being electrically connected to said second output voltage of said power distribution board, said transmitter board for transmitting and modulating the first carrier frequency.

2. The wireless headset, comprising:

a microphone for receiving a first audio signal and for generating a corresponding microphone electrical signal;

a portable receiver/transmitter electrically connected to said microphone for transmitting a first carrier frequency modulated according to the microphone electrical signal;

a remote receiver/transmitter for receiving and demodulating the modulated first carrier frequency to generate a first electrical signal corresponding to the microphone electrical signal, said remote receiver/transmitter also for transmitting a second carrier frequency modulated according to a second electrical signal;

said portable receiver/transmitter also for receiving and demodulating the second modulated carrier frequency to generate a speaker electrical signal corresponding to the second electrical signal;

a speaker electrically connected to said portable receiver/transmitter for transforming the speaker electrical signal into a second audio signal;

one of the first and second carrier frequencies being above 900 Megahertz, the other of the first and second carrier frequencies being below 900 Megahertz;

a speech processor being electrically connected to said remote receiver/transmitter for generating a first digital signal corresponding to the first electrical signal and generating the second electrical signal corresponding to a second digital signal;

a computer for receiving the first digital signal and generating and transmitting the second digital signal containing a speech processor command;

a power distribution board being electrically connectable to a battery and adapted to accept a voltage from the battery, said power distribution board for generating a first output voltage and a second output voltage, said first output voltage having a voltage level different than said second output voltage;

a receiver board being electrically connected to said first output voltage of said power distribution board, said receiver board for receiving and demodulating the second carrier frequency; and a transmitter board being electrically connected to said second output voltage of said power distribution board, said transmitter board for transmitting and modulating the first carrier frequency.

3. A wireless communication system, comprising:

a microphone for receiving a first audio signal and for generating a corresponding microphone electrical signal;

a portable receiver/transmitter electrically connected to said microphone for transmitting a first carrier frequency being above 900 Megahertz and modulated according to the microphone electrical signal;

a remote receiver/transmitter for receiving and demodulating the modulated first carrier frequency to generate a first electrical signal corresponding to the microphone electrical signal, said remote receiver/transmitter also for transmitting a second carrier frequency being below 900 Megahertz and modulated according to a second electrical signal;

said portable receiver/transmitter also for receiving and demodulating the second modulated carrier frequency to generate a speaker electrical signal;

a speaker electrically connected to said portable receiver/transmitter for transforming the speaker electrical signal into a second audio signal;

a speech processor being electrically connected to said remote receiver/transmitter for generating a first digital signal corresponding to the first electrical signal and generating the second electrical signal corresponding to a second digital signal;

a computer for receiving the first digital signal and generating and transmitting the second digital signal, said computer for generating a command to said speech processor;

a machine being electrically connected to said computer, said machine being capable of executing a command from said speech processor;

a power distribution board being electrically connectable to a battery and adapted to accept a voltage from the battery, said power distribution board for generating a first output voltage and a second output voltage, said first output voltage having a voltage level different than said second output voltage;

a receiver board being electrically connected to said first output voltage of said power distribution board, said receiver board for receiving and demodulating the second carrier frequency; and a transmitter board being electrically connected to said second output voltage of said power distribution board, said transmitter board for transmitting and modulating the first carrier frequency.

4. A wireless communication system, comprising:

a microphone for receiving a first audio signal and for generating a corresponding microphone electrical signal;

a portable receiver/transmitter electrically connected to said microphone for transmitting a first carrier frequency modulated according to the microphone electrical signal;

a remote receiver/transmitter for receiving and demodulating the modulated first carrier frequency to generate a first electrical signal corresponding to the microphone electrical signal, said remote receiver/transmitter also for transmitting a second carrier frequency modulated according to a second electrical signal;

said portable receiver/transmitter also for receiving and demodulating the second modulated carrier frequency to generate a speaker electrical signal;

a speaker electrically connected to said portable receiver/transmitter for transforming the speaker electrical signal into a second audio signal;

one of the first and second carrier frequencies being above 900 Megahertz;

a speech processor being electrically connected to said remote receiver/transmitter for generating a first digital signal corresponding to the first electrical signal and generating the second electrical signal corresponding to a second digital signal;

a computer for receiving the first digital signal and generating and transmitting the second digital signal, said computer for generating a command to said speech processor;

a power distribution board being electrically connectable to a battery and adapted to accept a voltage from the battery, said power distribution board for generating a first output voltage and a second output voltage, said first output voltage having a voltage level different than said second output voltage;

a receiver board being electrically connected to said first output voltage of said power distribution board, said receiver board for receiving and demodulating the second carrier frequency; and a transmitter board being electrically connected to said second output voltage of said power distribution board, said transmitter board for transmitting and modulating the first carrier frequency.

5. A wireless headset, comprising:

a microphone for receiving a first audio signal and for generating a corresponding microphone electrical signal;

a portable receiver/transmitter electrically connected to said microphone for transmitting a first carrier frequency modulated according to the microphone electrical signal;

a remote receiver/transmitter for receiving and demodulating the modulated first carrier frequency to generate a first electrical signal corresponding to the microphone electrical signal, said remote receiver/transmitter also for transmitting a second carrier frequency being below 900 Megahertz and modulated according to a second electrical signal;

said portable receiver/transmitter also for receiving and demodulating the second modulated carrier frequency to generate a speaker electrical signal corresponding to the second electrical signal;

a speaker electrically connected to said portable receiver/transmitter for transforming the speaker electrical signal into a second audio signal;

a power distribution assembly being electrically connectable to a battery and adapted to accept a voltage from the battery, said power distribution assembly for generating a first output voltage and a second output voltage, said first output voltage having a voltage level different than said second output voltage;

a receiver board being electrically connected to said first output voltage of said power distribution assembly, said receiver board for receiving and demodulating the second carrier frequency; and a transmitter board being electrically connected to said second output voltage of said power distribution assembly, said transmitter board for transmitting and modulating the first carrier frequency.

6. The wireless headset, comprising:

a microphone for receiving a first audio signal and for generating a corresponding microphone electrical signal;

a portable receiver/transmitter electrically connected to said microphone for transmitting a first carrier frequency modulated according to the microphone electrical signal;

a remote receiver/transmitter for receiving and demodulating the modulated first carrier frequency to generate a first electrical signal corresponding to the microphone electrical signal, said remote receiver/transmitter also for transmitting a second carrier frequency modulated according to a second electrical signal;

said portable receiver/transmitter also for receiving and demodulating the second modulated carrier frequency to generate a speaker electrical signal corresponding to the second electrical signal;

a speaker electrically connected to said portable receiver/transmitter for transforming the speaker electrical signal into a second audio signal;

one of the first and second carrier frequencies being below 900 Megahertz;

a speech processor being electrically connected to said remote receiver/transmitter for generating a first digital signal corresponding to the first electrical signal and generating the second electrical signal corresponding to a second digital signal;

a computer for receiving the first digital signal and generating and transmitting the second digital signal containing a speech processor command;

a power distribution assembly being electrically connectable to a battery and adapted to accept a voltage from the battery, said power distribution assembly for generating a first output voltage and a second output voltage, said first output voltage having a voltage level different than said second output voltage;

a receiver board being electrically connected to said first output voltage of said power distribution assembly, said receiver board for receiving and demodulating the second carrier frequency; and a transmitter board being electrically connected to said second output voltage of said power distribution assembly, said transmitter board for transmitting and modulating the first carrier frequency.

7. A wireless communication system, comprising:

a microphone for receiving a first audio signal and for generating a corresponding microphone electrical signal;

a portable receiver/transmitter electrically connected to said microphone for transmitting a first carrier frequency being above 900 Megahertz and modulated according to the microphone electrical signal;

a remote receiver/transmitter for receiving and demodulating the modulated first carrier frequency to generate a first electrical signal corresponding to the microphone electrical signal, said remote receiver/transmitter also for transmitting a second carrier frequency being below 900 Megahertz and modulated according to a second electrical signal;

said portable receiver/transmitter also for receiving and demodulating the second modulated carrier frequency to generate a speaker electrical signal;

a speaker electrically connected to said portable receiver/transmitter for transforming the speaker electrical signal into a second audio signal;

a speech processor being electrically connected to said remote receiver/transmitter for generating a first digital signal corresponding to the first electrical signal and generating the second electrical signal corresponding to a second digital signal;

a computer for receiving the first digital signal and generating and transmitting the second digital signal, said computer for generating a command to said speech processor;

a machine being electrically connected to said computer, said machine being capable of executing a command from said speech processor;

a power distribution assembly being electrically connectable to a battery and adapted to accept a voltage from the battery, said power distribution assembly for generating a first output voltage and a second output voltage, said first output voltage having a voltage level different than said second output voltage;

a receiver board being electrically connected to said first output voltage of said power distribution assembly, said receiver board for receiving and demodulating the second carrier frequency; and a transmitter board being electrically connected to said second output voltage of said power distribution assembly, said transmitter board for transmitting and modulating the first carrier frequency.

8. A wireless communication system, comprising:

a microphone for receiving a first audio signal and for generating a corresponding microphone electrical signal;

a portable receiver/transmitter electrically connected to said microphone for transmitting a first carrier frequency modulated according to the microphone electrical signal;

a remote receiver/transmitter for receiving and demodulating the modulated first carrier frequency to generate a first electrical signal corresponding to the microphone electrical signal, said remote receiver/transmitter also for transmitting a second carrier frequency modulated according to a second electrical signal;

said portable receiver/transmitter also for receiving and demodulating the second modulated carrier frequency to generate a speaker electrical signal;

a speaker electrically connected to said portable receiver/transmitter for transforming the speaker electrical signal into a second audio signal;

one of the first and second carrier frequencies being above 900 Megahertz;

a speech processor being electrically connected to said remote receiver/transmitter for generating a first digital signal corresponding to the first electrical signal and generating the second electrical signal corresponding to a second digital signal;

a computer for receiving the first digital signal and generating and transmitting the second digital signal, said computer for generating a command to said speech processor;

a power distribution assembly being electrically connectable to a battery and adapted to accept a voltage from the battery, said power distribution assembly for generating a first output voltage and a second output voltage, said first output voltage having a voltage level different than said second output voltage;

a receiver board being electrically connected to said first output voltage of said power distribution assembly, said receiver board for receiving and demodulating the second carrier frequency; and a transmitter board being electrically connected to said second output voltage of said power distribution assembly, said transmitter board for transmitting and modulating the first carrier frequency.

* * * * *

UNITED STATES PATENT AND TRADEMARK OFFICE

CERTIFICATE OF CORRECTION

PATENT NO : 5,982,904

DATED : November 9, 1999

INVENTOR(S) : Khosrow Eghtesadi, et al.

It is certified that error appears in the above-identified patent and that said Letters Patent is hereby corrected as shown below:

On the title page,

In Figure 1: The term "microwave" should be "microphone."

In Figure 2: The term "microwave" should be "microphone."

In Figure 3: The term "microwave" should be "microphone."

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*